US005709571A

United States Patent [19]

Briski et al.

[11] Patent Number: 5,709,571

[45] Date of Patent: Jan. 20, 1998

[54] WEDGE-BASE LAMP SOCKET WITH TERMINAL COVER

[75] Inventors: Curt M. Briski, Westland; Mark S. Grant, Livonia, both of Mich.

[73] Assignee: Yazaki Corporation, Tokyo, Japan

[21] Appl. No.: 603,394

[22] Filed: Feb. 20, 1996

[51] Int. Cl.[6] ..... H01R 17/00

[52] U.S. Cl. ..... 439/699.2; 439/619

[58] Field of Search ..... 439/699.2, 558, 439/619, 280, 336, 360, 375, 56, 57

[56] References Cited

U.S. PATENT DOCUMENTS

| | | | |
|---|---|---|---|
| 3,324,442 | 6/1967 | Greasley | 439/57 |
| 4,573,754 | 3/1986 | Hill | 439/699.2 |
| 4,957,455 | 9/1990 | Horiuchi et al. | 439/548 |
| 5,286,223 | 2/1994 | Agawa | 439/699.2 |

*Primary Examiner*—Gary F. Paumen
*Assistant Examiner*—Tho Dac Ta
*Attorney, Agent, or Firm*—Young & Basile, P.C.

[57] ABSTRACT

A socket for operatively holding a wedge-base lamp has terminal guards positioned within a lamp receptacle to protect electrical terminals inside the receptacle from damaging contact by a lamp as it is inserted into the receptacle. The guards comprise a pair of terminal covers located between the terminals and the open end of the receptacle, the covers defining a gap which receives a base portion of the lamp and guides it into a proper position with respect to the terminals. The lamp base has a pair of lead wires which make contact with the terminals, and guide notches formed in the gap-defining edges of the guards engage the wires and draw them into contact with the terminals as the lamp base passes through the gap.

12 Claims, 2 Drawing Sheets

WEDGE-BASE LAMP SOCKET WITH TERMINAL COVER

FIELD OF THE INVENTION

This invention relates to sockets for holding and providing electrical power to wedge-base lamps such as are used in automotive vehicles.

BACKGROUND OF THE INVENTION

Many automotive vehicle lights, such as courtesy lights, parking lights, etc., employ wedge-base lamps. A wedge-base lamp comprises a bulb portion containing a filament, and a substantially flat base portion from which a pair of lead wires connected with the filament extend. The lamp base is inserted into a receptacle at one end of a lamp socket, and a pair of terminals in the receptacle serve both to make electrical contact with the lead wires and to physically retain the lamp in the receptacle. Each terminal has two prongs and functions in the manner of a spring-clip, the prongs gripping the lamp base when it is wedged therebetween. The lead wires are bent to lay over the surface of the base in positions to make electrical contact with the terminals when the lamp is properly inserted into the receptacle.

If the lamp is not properly aligned with the receptacle as it is inserted therein, it is possible for the base of the lamp to contact the terminals improperly and bend or scratch one or more of the prongs rather than sliding between them as it is urged into the socket. This can result in poor electrical contact between the terminals and lead wires. It is also possible for the lamp to be inserted too deeply into the receptacle, and such over-insertion may result in a poor electrical connection or in damage to the socket, terminals, or the lamp.

It is also possible for the lead wires to become displaced from their proper positions with respect to the base during manufacturing or shipping and handling. If the lead wires are not properly located on the lamp base prior to insertion, the wires may not make good contact with the terminals even if the lamp is properly positioned within the receptacle.

SUMMARY OF THE INVENTION

The present invention is directed toward a wedge-base lamp socket featuring means for guiding a lamp into the proper position within a lamp receptacle of the socket to thereby ensure electrical contact between terminals contained within the receptacle and lead wires of the lamp. The socket includes means for protecting the terminals against bending or scratching that may be caused if the lamp is not properly aligned with the socket as it is inserted therein, and also means to guide the lead wires of the lamp into proper position with respect to the terminals if the wires are improperly arranged prior to insertion.

According to the invention, terminal guard means is installed in the lamp receptacle to be positioned substantially between an insertion end of the socket and ends of the terminals adjacent to the insertion end. During insertion of the lamp into the receptacle, the guard means prevents the lamp from contacting the terminals in a manner that would tend to bend or scratch them, and guides the lamp into proper contact with the terminals. By preventing damage to the terminals, the guard means ensures adequate electrical contact between the terminals and the lamp.

According to another feature of the invention, the terminals are in the form of spring-clips comprising pairs of prongs which receive a base portion of the lamp therebetween when the lamp is inserted into the receptacle, and the terminal guard means comprises two terminal covers defining a gap aligned with the space between the prongs. Insertion of the lamp base through the gap guides the lamp base between the respective pairs of prongs.

According to a further feature of the invention, the terminal covers are positioned to physically obstruct insertion of the lamp into the receptacle beyond a desired insertion depth. This prevents over-insertion of the lamp which may damage the lamp, the socket, or the terminals.

According to yet another feature of the invention, the terminal covers have beveled inner edges adjacent the gap, the bevels serving to guide the lamp base into the gap when the lamp is urged into the lamp receptacle.

According to a still further feature of the invention, the inner edges of the terminal covers have concave curved portions which together define a substantially circular section at the center of the gap. The circular section accepts a circular portion of the lamp base when the lamp is inserted in the receptacle.

According to still another feature of the invention, the terminal cover inner edges are formed with guide notches positioned to engage the lead wires as the lamp moves downward into the lamp receptacle. This engagement straightens the wires and urges them into a proper position with respect to the terminals so that electrical contact with the terminals is enhanced.

According to another feature of the invention, the terminal covers are formed separately from the socket body and include locating hubs engagable with cooperatively shaped notches formed in the socket body to secure the covers in operative position within the receptacle.

Detailed Description of the Preferred Embodiment

Figure 1:
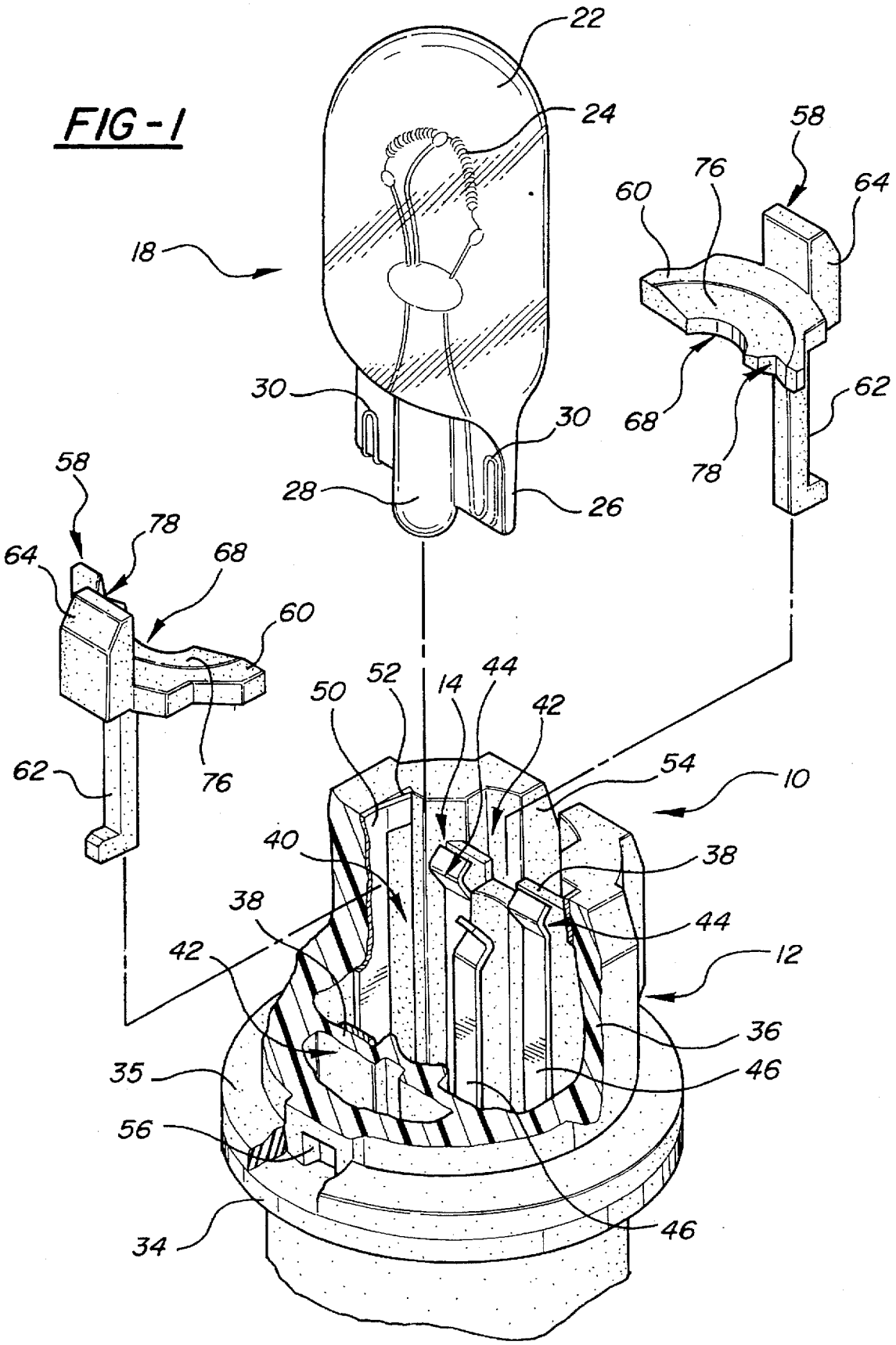
FIG. 1 is a perspective cut-away view of a wedge-base lamp socket according to the present invention.
Figure 2:
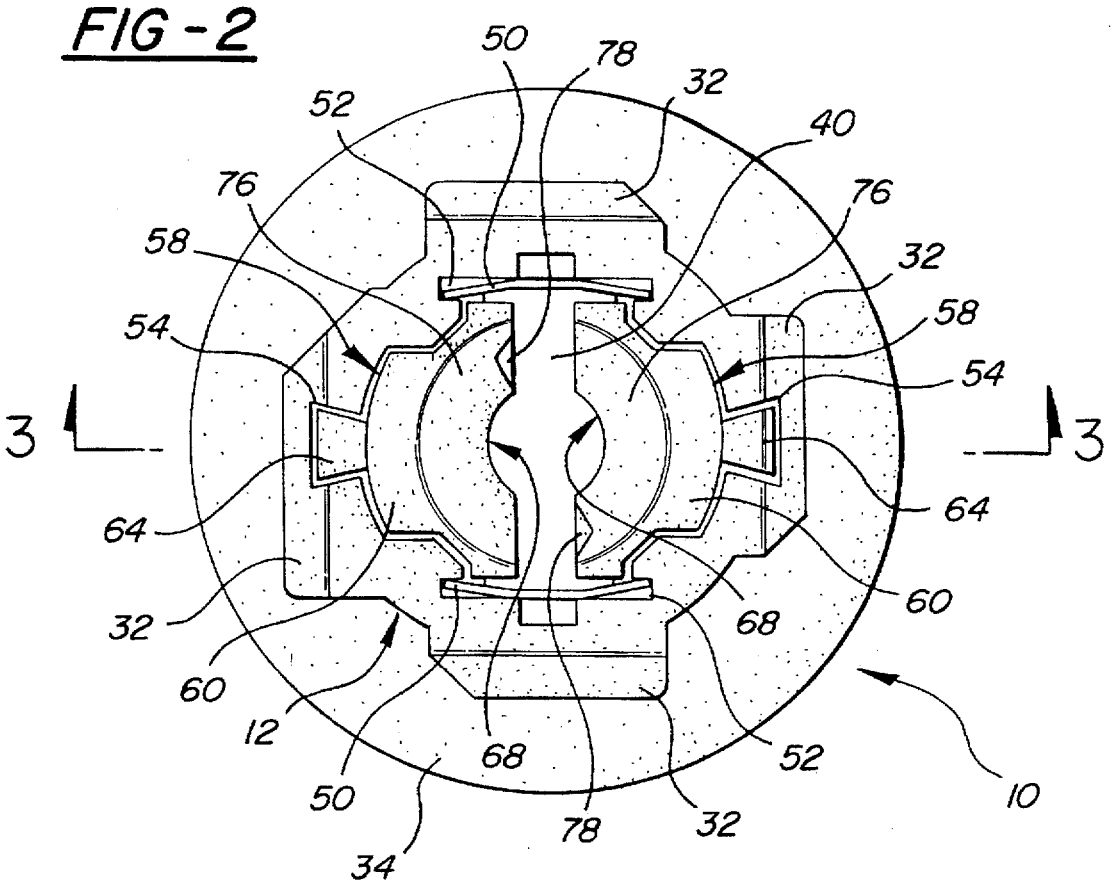
FIG. 2 is a top view of the lamp socket of FIG. 1.
Figure 3:
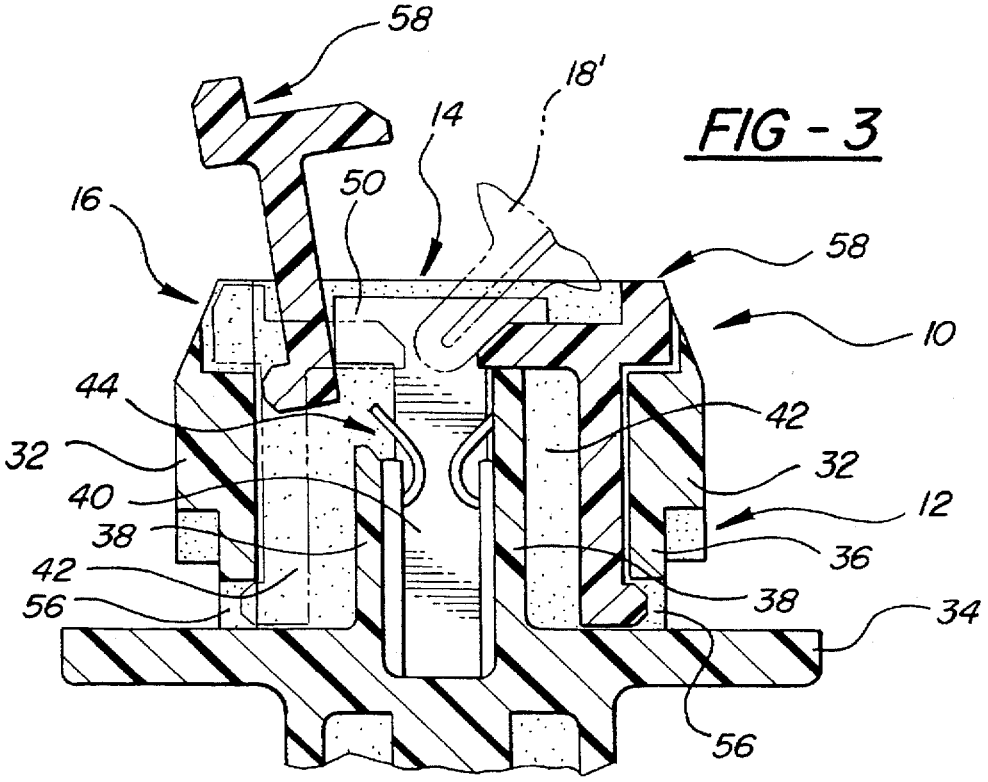
FIG. 3 is a cross-sectional view taken along line 3—3 of FIG. 2.

FIGS. 1 through 3 depict a wedge-base lamp socket 10 comprising a socket body 12 of an overall cylindrical shape and made of an electrically insulative material such as a synthetic resin. Socket body 12 has a lamp receptacle 14 formed therein, the receptacle adapted to receive a standard wedge-base lamp 18 at an insertion end 16, and a connector receptacle (not shown) formed at the opposite end of the body is adapted to receive a mating electrical connector (not shown) supplying electrical power to the lamp. A bulb portion 22 of lamp 18 contains a filament 24, and a base portion 26 is substantially flat with a rounded section 28 at its center. Lead wires 30 are connected to filament 24 and protrude from the bottom edge of the base. After exiting lamp base 26, lead wires 30 are bent or folded upward to lay over the surfaces of the base, substantially perpendicular to the bottom edge the base, with one wire positioned on each surface and at opposite ends of the base.

A plurality of retention lugs 32 are formed around the circumference of socket body 12 adjacent insertion end 16. Retention lugs 32 serve to hold socket body 12 in engagement with a panel (not shown) when the insertion end of the body is urged through a hole in the panel and twisted. An annular flange 34 surrounds socket body 12 immediately below retention lugs 32 and supports a gasket 35 which is compressed against the panel when the socket is mounted thereto.

Lamp receptacle 14 is defined by a generally annular outer wall 36, and a pair of parallel internal walls 38 are formed integrally with outer wall 36 inside of the receptacle. Internal walls 38 divide lamp receptacle 14 into three portions: a lamp base insertion channel 40 between the internal walls, and two cavities 42 between outer walls 36 and internal walls 38. The center portions of the inward facing surfaces of internal walls 38 are concave in shape so that lamp base insertion channel 40 has a circular center area.

Two terminals 44 are positioned between internal walls 38, one at either end of lamp base insertion channel 40. Terminals 44 are stamped or otherwise formed from thin pieces of an electrically conductive metal such as copper, and each terminal comprises a pair of spaced apart prongs 46 connected at their lower ends to an end plate 50. End plates 50 maintain the prongs in spaced relationship to one another and are held tightly in terminal retention slots 52 formed in outer wall 36, thereby securing terminals 44 in place within lamp base insertion channel 40. Terminal prongs 46 are spaced relatively far apart at their lower ends, curve toward each other to be closer to one another adjacent their upper ends, then curve away from each other at their tips. The spacing between prongs 46 at the narrowest point is less than the thickness of lamp base 26.

Recesses 54 are formed in the rim of outer wall 36 adjacent cavities 42 and, as best seen in FIG. 2, have a dove-tail shape as viewed from above, widening toward the outside of socket body 12. Positioning holes 56 penetrate outer wall 36 at the bottom of cavities 42, immediately above flange 34.

A pair of terminal covers 58 are positioned inside of lamp receptacle 14, each cover comprising a substantially flat cover portion 60, an elongated locating leg 62 projecting downward from a lower surface of the cover portion, and a dove-tail shaped locating nub 64 projecting upwardly from the cover portion. Terminal covers 58 are made of an electrically insulative material such as thermoplastic resin.

Each cover portion 60 is generally arcuate in shape, with a concave cutout 68 located at the center of an otherwise straight inner edge. The outer edge of cover portion 60 is shaped to match the interior contours of outer wall 36 in the vicinity of cavity 42. An arcuate bevel 76 surrounds concave cutout 68, and a V-shaped guide notch 78 is formed in the inner edge of cover portion 60 to one side of the cutout. Locating leg 62 extends substantially perpendicularly from cover portion 60 and has a tab 80 at its distal end.

Terminal covers 58 fit inside of lamp receptacle 14 such that cover portions 60 contact the tops of respective inner walls 38 and are positioned directly above the upper ends of terminal prongs 46, with the inner edges of the covers defining therebetween an opening or gap of sufficient width to allow passage therethrough of lamp base 26. When terminal covers 58 are so positioned, locating legs 62 extend downwardly into cavities 42 with tabs 80 at the ends of the legs projecting into positioning holes 56 (as depicted on the right side of FIG. 3), and locating nubs 64 engage recesses 54 with the dove-tail shapes of the nubs and the recesses cooperating to hold terminal covers 58 in place.

To place a terminal cover 58 in position inside of lamp receptacle 14, the terminal cover is tipped away from the vertical, as shown on the left side of FIG. 3, so that locating leg 62 may be inserted downward into cavity 42, and locating nub 64 is simultaneously inserted into recess 54. Terminal cover 58 is then returned to an upright orientation so that tab 80 projects into positioning hole 56. When terminal covers 58 are properly positioned, the straight segments of the cover portion inner edges are located directly between the tips of terminal prongs 46 and insertion end 16 of receptacle 14, and the gap between the inner edges of the covers is narrower than the distance between the prongs at their upper ends.

Lamp 18 is inserted into lamp receptacle 14 by placing lamp base 26 proximate insertion end 16 of the receptacle and urging the base through the gap between terminal covers 58. As seen in FIG. 3, terminal covers 58 overhang the tips of terminal prongs 46 so that even a lamp 18' that is badly misaligned with socket body 12 is prevented from contacting a prong close to its tip in a manner likely to bend or otherwise damage the prong as the lamp is urged into the socket. Bevels 76 aid in guiding the base of a misaligned lamp 18' between opposing prongs 46 of the terminals, and the prongs flex slightly apart to receive lamp base 26 therebetween. The flexibility of terminal prongs 46 causes them to act as a spring clip, gripping base 26 to hold lamp 18 securely in receptacle 14 and make positive electrical contact with lead wires 30.

When lamp 18 is inserted in lamp receptacle 16, guide notches 78 are aligned with the points on lamp base 26 at which lead wires 30 extend. As lamp base 26 is urged downward into lamp base insertion channel 40, the relatively tight clearance between the inner edges of covers 60 and the sides of the lamp base causes lead wires 30 to be drawn through guide notches 78. If, prior to lamp 18 being inserted into socket 10, lead wires 30 do not lie perpendicular to the bottom edge of lamp base 26 as shown in FIG. 1, the passage of the wires through guide notches 78 acts to draw the wires back to that desired position, wherein proper electrical contact with terminals 44 is enhanced.

When fully inserted in lamp receptacle 14, the bottom end of bulb 22 contacts covers 60 so that lamp 18 is prevented from being inserted into lamp receptacle 14 beyond a desired depth at which proper electrical contact between lead wires 30 and terminals 44 is established.

It is thus apparent that the terminal covers of the invention wedge-base lamp socket serve to guide the base portion of the lamp into proper engagement with the terminals within the lamp receptacle, thereby preventing damage to the terminals that may be caused by the attempted insertion of a lamp when it is misaligned with respect to the socket. The terminal covers also prevent over-insertion of the lamp into the socket. Further, the guide notches formed in the terminal covers serve to correct any mis-positioning of the lead wires on the lamp base as the base is inserted between the covers.

Whereas a preferred embodiment of the invention has been illustrated and described in detail, it will be apparent that various changes may be made in the disclosed embodiment without departing from the scope or spirit of the invention.

We claim:

1. A socket for receiving and providing electrical power to a wedge-base lamp, the socket comprising:

a body having a lamp receptacle for receiving the lamp, the lamp receptacle having an insertion end;

electrical terminals disposed within the lamp receptacle and retained by the body for making electrical contact with the lamp, the terminals having ends adjacent the insertion end; and terminal guard means separate from the body and the terminals for insertion into the lamp receptacle to a position between the insertion end and the terminal ends, whereby the guard means guides the lamp into proper contact with the terminals during insertion of the lamp into the lamp receptacle.

2. A wedge-base lamp socket according to claim 1 wherein at least one of the terminals comprises first and second prongs spaced from one another and adapted to receive therebetween a base of the lamp when the lamp is inserted into the receptacle, and the terminal guard means comprises first and second terminal covers defining therebetween a gap aligned with the space between the prongs, whereby insertion of the lamp base through the gap guides the lamp base between the respective first and second prongs.

3. A wedge-base lamp socket according to claim 2 wherein the terminal covers are positioned to physically obstruct insertion of the lamp into the receptacle beyond a desired insertion depth.

4. A wedge-base lamp socket according to claim 2 wherein at least one of the terminal covers has a beveled inner edge adjacent the gap for guiding the lamp base into the gap.

5. A wedge-base lamp socket according to claim 2 wherein the first and second terminal covers have inner edges adjacent to the gap, the inner edges having concave curved portions which together define a substantially circular section of the gap to accept a circular portion of the lamp base when the lamp is inserted in the lamp receptacle.

6. A wedge-base lamp socket according to claim 2 comprising means for guiding at least one lead wire disposed on the base of the lamp into proper contact with one of the terminals during insertion of the lamp into the lamp receptacle.

7. A wedge-base lamp socket according to claim 6 wherein the first and second terminal covers have inner edges adjacent to the gap, and the lead wire guide means comprises at least one notch formed in the inner edge of at least one of the covers, the notch positioned to engage the lead wire and urge the lead wire into a proper position with respect to one of the terminals.

8. A wedge-base lamp socket according to claim 2 wherein the terminal covers are formed separately from the socket body and include means engagable with the socket body to secure the covers in operative position within the receptacle.

9. A wedge-base lamp socket according to claim 8 wherein the cover positioning means comprises at least one locating nub engageable with a cooperatively shaped recess formed in the socket body.

10. A wedge-base lamp socket having means for guiding at least one lead wire disposed on a base of a lamp into proper contact with a terminal located within a lamp receptacle of the socket when the lamp base is inserted into the receptacle, the guide means having edges defining a gap for receiving the lamp base and having at least one notch formed in at least one of the edges adjacent the gap and the terminal, the notch positioned to engage the at least one lead wire and urge the lead wire into a proper position with respect to the terminal as the lamp base is inserted into the receptacle.

11. Means insertable into a lamp receptacle of a wedge-base lamp socket prior to insertion of a lamp into the receptacle, the inserted means being positioned between an insertion end of the receptacle and at least one terminal within the receptacle and having edges defining a gap for receiving a base of the lamp, at least one of the edges having a notch positioned to engage a lead wire disposed on the lamp base and guide the lead wire into a proper position with respect to the terminal as the lamp is inserted into the receptacle.

12. A socket for receiving and providing electrical power to a wedge-base lamp having a base with lead wires disposed thereon, the socket comprising:

a socket body having a lamp receptacle adjacent an insertion end of the body for receiving the lamp;

first and second electrical terminals disposed within the lamp receptacle and retained by the socket body, each terminal including a pair of spaced apart prongs for gripping therebetween the lamp base and making electrical contact with one of the lead wires; and first and second terminal covers formed separately from the socket body and insertable into the receptacle to a position between the insertion end of the socket body and ends of the prongs proximate to the insertion end, the covers defining therebetween a gap through which the lamp base must pass to make contact with the terminals, the gap being of a width narrower than the spacing between pairs of terminal prongs whereby the insertion of the lamp base through the gap guides the lamp base into position between the prongs.

* * * * *